US006006974A

United States Patent [19]

Varney et al.

[11] Patent Number: 6,006,974

[45] Date of Patent: Dec. 28, 1999

[54] GOLF BAG CARRYING STRAPS

[75] Inventors: David J. Varney, Fairport; Michael D. Renahan, Penfield, both of N.Y.

[73] Assignee: Morris Rosenbloom & Co., Inc., Macedon, N.Y.

[21] Appl. No.: 09/186,283

[22] Filed: Nov. 5, 1998

[51] Int. Cl.[6] ..... A45F 3/04

[52] U.S. Cl. ..... 224/645; 224/627; 224/259; 224/614

[58] Field of Search ..... 224/600, 614, 224/615, 616, 617, 606, 627, 645, 257, 259

[56] References Cited

U.S. PATENT DOCUMENTS

| | | | |
|---|---|---|---|
| 384,736 | 6/1888 | Bedford | 224/616 X |
| 1,696,191 | 12/1928 | Coulson | 224/627 |
| 1,809,120 | 6/1931 | Hall . | |
| 1,951,492 | 3/1934 | Schneider | 150/1.5 |
| 2,165,348 | 7/1939 | Daiber | 2/94 |
| 2,256,521 | 9/1941 | Kirkpatrick et al. | 150/1.5 |
| 2,533,440 | 12/1950 | Endee | 150/1.5 |
| 2,820,498 | 1/1958 | Endee | 150/1.5 |
| 2,853,111 | 9/1958 | Williams | 150/1.5 |
| 3,622,056 | 11/1971 | Droeger | 224/9 |
| 3,882,914 | 5/1975 | Strutz | 150/1.5 R |
| 4,074,839 | 2/1978 | Wood et al. | 224/8 R |
| 4,116,310 | 9/1978 | Shields | 224/616 X |
| 4,155,387 | 5/1979 | Costa | 150/1.5 R |
| 4,487,347 | 12/1984 | Zegar | 224/645 X |
| 4,750,652 | 6/1988 | Grant | 224/627 |
| 5,038,984 | 8/1991 | Izzo | 224/209 |
| 5,042,703 | 8/1991 | Izzo | 224/209 |
| 5,042,704 | 8/1991 | Izzo | 224/209 |
| 5,348,205 | 9/1994 | Steurer | 224/645 X |
| 5,429,288 | 7/1995 | Sattler | 224/617 X |
| 5,558,259 | 9/1996 | Izzo | 224/645 X |
| 5,593,077 | 1/1997 | Izzo | 224/627 |
| 5,636,778 | 6/1997 | Jones et al. | 224/627 |

*Primary Examiner*—Gregory M. Vidovich
*Attorney, Agent, or Firm*—Jacobson, Price, Holman & Stern, PLLC

[57] ABSTRACT

A golf bag with two carrying straps to enable a golfer, caddy or others to carry a golf bag by inserting their arms through a pair of loops defined by the carrying straps in order for the golf bag to be carried over both shoulders. Alternatively, the golf bag can be carried by only one of the straps in a conventional and well known manner by inserting one arm through a loop formed by one of the straps to support the bag from only one shoulder.

16 Claims, 3 Drawing Sheets

GOLF BAG CARRYING STRAPS

BACKGROUND OF THE INVENTION

1. Field of the Invention

This invention relates to a golf bag with two carrying straps to enable a golfer, caddy or others to carry a golf bag by inserting their arms through a pair of loops defined by the carrying straps in order for the golf bag to be carried over both shoulders. Alternatively, the golf bag can be carried by only one of the straps in a conventional and well known manner by inserting one arm through a loop formed by one of the straps to support the bag from only one shoulder.

2. Description of the Prior Art

Golf has become increasingly, popular as a recreational sport in view of the health benefits derived from the walking exercise, the development of muscles and coordination when hitting the ball and environmental benefits from being outdoors for extended periods. As an increasing number of people retire at earlier ages, it sometimes is difficult to obtain the services of a caddy to carry the golf bag and it is expensive to purchase or rent a golf bag cart and even more expensive to rent a motorized cart. Accordingly, the incidence of golfers carrying their own clubs has materially increased in view of the beneficial exercise and reduction in overall cost of playing golf.

Golf bags conventionally utilize a carrying strap in addition to a carrying handle in which the carrying strap forms a loop through which one arm can be inserted in order for the loop to engage and be supported over one shoulder of the person carrying the bag. A single carrying strap which forms a single loop not only creates an uncomfortable force on a single shoulder but also has the tendency of slipping off the shoulder. This can result in muscle fatigue, discomfort or injury due to the tendency of the golf bag carrier to elevate the shoulder which is engaged by the golf bag strap.

Various efforts have been made to provide golf bag carrying strap arrangements which are more comfortable, more dependable and distribute the carrying forces more evenly on the anatomical surfaces of the person carrying the bag.

The following patents disclose various carrying strap arrangements for golf bags.

| | | |
|---|---|---|
| 1,809,120 | 2,820,498 | 4,155,387 |
| 1,951,492 | 2,853,111 | 5,038,984 |
| 2,165,348 | 3,622,056 | 5,042,703 |
| 2,256,521 | 3,882,914 | 5,042,704 |
| 2,533,440 | 4,074,839 | |

Several of the above patents disclose the use of a single shoulder strap connected with a golf bag in order to support the bag from one shoulder. U.S. Pat. No. 2,853,111 discloses a golf bag with a pair of straps attached thereto at spaced points along the length thereof to provide two loops through which the arms can be inserted so that the straps support the golf bag from both shoulders of the person carrying the bag with the bag oriented transversely across the back and below the shoulders of the person carrying the golf bag. U.S. Pat. Nos. 5,038,984, 5,042,703 and 5,042,704 disclose a dual strap arrangement in which two shoulder loops are formed to support the bag from both shoulders of the person carrying the golf bag with the golf bag oriented transversely of the back and below the shoulders of the person carrying the bag. U.S. Pat. Nos. 2,165,348 and 3,622,056 and 4,074,839 disclose back packs including a single strap or dual straps forming two loops through which the arms of the back pack carrier are inserted to support the back pack from both shoulders of the person carrying the back pack.

While the above patents disclose various carrying arrangements defining a pair of loops to engage both shoulders of a person carrying a golf bag, back pack or similar load with the load force being exerted on and supported by both shoulders of the carrier, the prior art does not disclose a double strap arrangement in which both straps are adjustably and/or detachably connected to the golf bag. Additionally, the prior art does not disclose the pair of straps detachably connected to a connector plate at opposite corners therewith with the connector plate including a slot structure receiving an adjustable retainer strap connected with the existing handle of a golf bag in a fixed or adjustable relation to the length of the handle to maintain an optimum balance point for the golf bag.

SUMMARY OF THE INVENTION

The golf bag carrying strap of this invention includes a pair of flexible shoulder pads having a webbing strap connected to each end of each pad with the straps connected with the golf bag in a manner to form two loops through which the arms of the golf bag carrier can be inserted in order to support the golf bag from both shoulders of a person carrying the golf bag. The golf bag is oriented in an inclined transverse relationship to the carrier so that the open end of the golf bag is oriented above the closed end to retain the golf clubs in the golf bag. The straps are oriented longitudinally of the bag and outwardly of and in alignment with the bag handle. The open end of the golf bag is provided with a rigid, square, circular, oval, rectangular or D-ring rigidly or pivotally connected to the bag at the open end. The end of the strap attached to the ring includes a slide buckle to vary the effective length of the strap and to detachably connect the strap to the ring at the open end of the bag. The end of the strap connected to the bag between the handle and the closed end of the bag includes a slide buckle to vary the effective length of the strap and to detachably connect the strap to a similar ring rigidly or pivotally affixed to the bag.

Each of the pair of straps includes a rigid connecting member at the end thereof opposite to the end connected to the bag. The connecting member on the end of each strap is detachably connected to a rigid connector plate with the connector plate including a pair of spaced headed or shouldered studs or pins engaged with generally keyhole shaped openings in the connecting members on the strap ends. Each keyhole slot includes converging edges with projections which provide a snap lock engagement with the headed studs or pins on the connector plate. The connector plate includes a slot receiving an adjustable retaining strap looped through the slot and connected thereto by stitching. The retaining strap encircles the golf bag handle and is connected thereto by a slide buckle which enables adjustment of the strap and detachably connects the retaining strap to the handle. The retaining strap engages the handle and is retained in an optimum relation to the golf bag handle in order to maintain a desired balance point for the golf bag when the pair of straps support the bag in an inclined relation with the open end of the golf bag oriented above the closed end of the golf bag. This structure enables the straps to be distributed as an accessory for attachment to existing golf bags.

An object of the present invention is to provide a golf bag with a pair of carrying straps connected to the bag to provide a pair of loops that can be engaged with both shoulders of a person carrying the golf bag in order to distribute the weight of the golf bag and the forces exerted by the golf bag onto both shoulders of the carrier with the pair of straps also enabling alternative use of the carrying straps by using only a single strap engaged with only one shoulder of the golf bag carrier.

Another object of the invention is to provide a golf bag with a pair of carrying straps in which each strap has a shoulder pad incorporated therein constituting a major portion of the length of each strap with each strap adjustably and detachably connected to the golf bag at remote points and detachably connected to a connector plate connected to the golf bag handle by an adjustable flexible retaining strap.

A further object of the invention is to provide a golf bag having a pair of carrying straps attached thereto in accordance with the preceding objects in which the connection between the connecting members on the ends of the straps and the connector plate includes headed or shouldered studs or pins on the connector plate engaged with keyhole shaped slots in the connecting members with the keyhole shaped slots having a snap lock engagement with the studs or pins.

Still another object of the invention it to provide a golf bag with carrying straps in accordance with the preceding objects in which the flexible, adjustable retaining strap between the connector plate and golf bag handle is retained in predetermined relation to the longitudinal length of a golf bag handle to maintain an optimum balance point for the golf bag when each of the straps is engaged with one of the shoulders of a person carrying the bag to maintain an optimum balance point for the golf bag.

A still further object of the invention is to provide a golf bag with a pair of carrying straps as set forth in the preceding objects in which the point of connection between the connecting members on the ends of the straps and the connector plate are spaced axially of the golf bag to enable the connector plate and the longitudially axis of the straps to vary their angular relationship about the axis of the headed or shouldered studs or pins and varying the point of connection between the handle and retaining strap axially of the golf bag.

These together with other objects and advantages which will become subsequently apparent reside in the details of construction and operation as more fully hereinafter described and claimed, reference being had to the accompanying drawings forming apart hereof, wherein like numerals refer to like parts throughout.

DESCRIPTION OF THE PREFERRED EMBODIMENT

Figure 1:
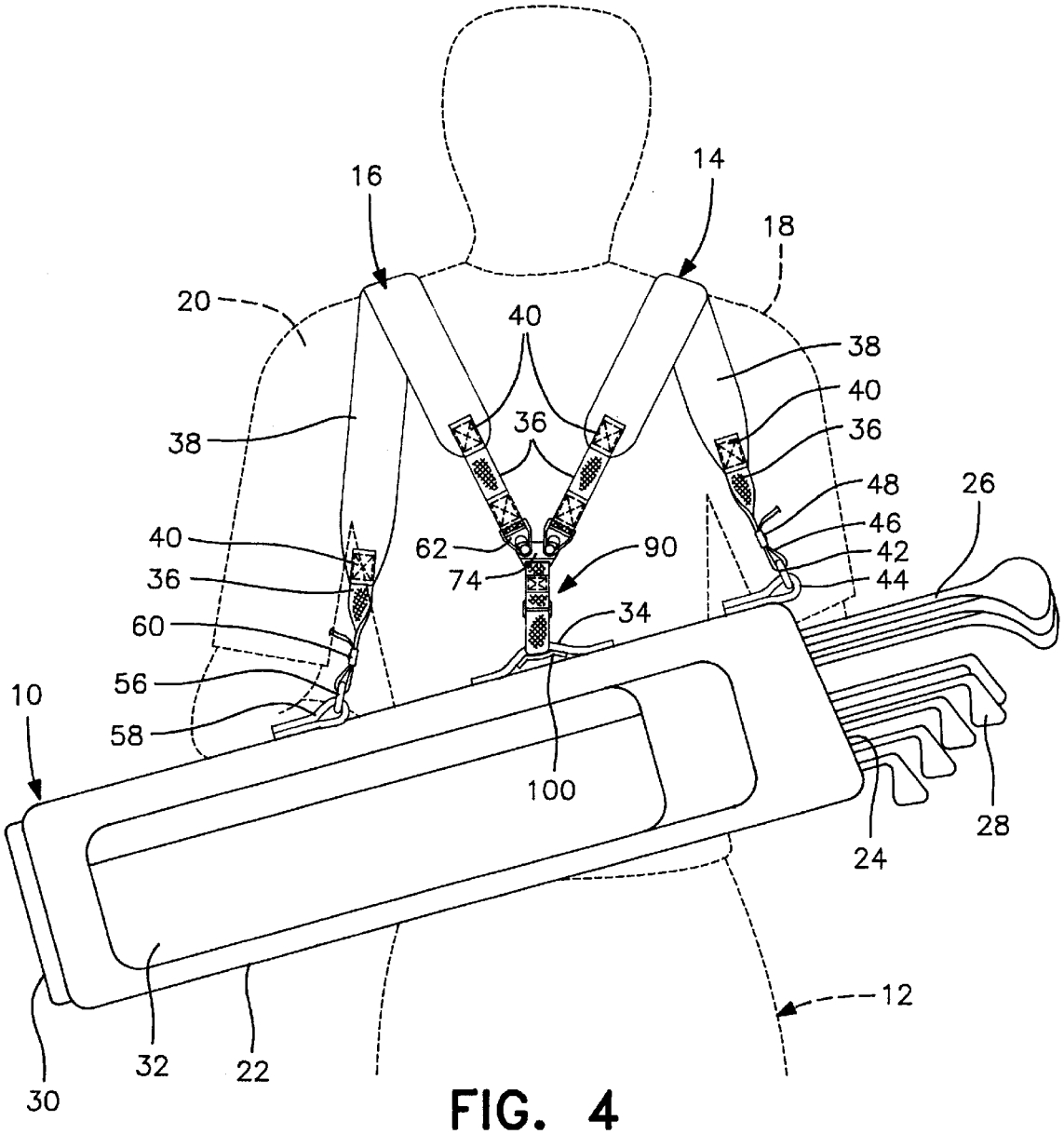
FIG. 1 is a rear elevational view of a golf bag with a pair of carrying straps connected thereto and supported by both shoulders of a person carrying the golf bag in accordance with the present invention.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

As illustrated in FIG. 1, a golf bag 10 is supported from a person 12 carrying the golf bag by use of a pair of carrying straps generally designated at 14 and 16 which engage the shoulders 18 and 20 of the golf bag carrier 12. The person carrying the bag is illustrated in broken line in FIG. 1 in order to illustrate the relationship of the golf bag 10, the pair of straps 14 and 16 and the shoulders 18 and 20 of the person carrying the golf bag.

The golf bag 10 includes a tubular body 22 having an open end 24 into which a plurality of golf clubs 26 can be inserted with the golf club heads 28 projecting from the open end 24 of the golf bag 10. The other end of the tubular body 22 is closed as indicated by reference numeral 30 and the side wall of the tubular body may be provided with pockets 32 for golf balls, golf club head covers, towels, golf tees and the like. Also, the golf bag 10 includes a handle 34 extending longitudinally of the bag and oriented in adjacent but spaced relation to the open end 24 with the ends of the handle 34 being fixedly attached to the bag by rivets or other securing structures with the central portion of the handle being arcuately curved and constructed of shape sustaining material having interior cushioning material on the inner surface thereof to provide a comfortable carrying handle for the golf bag in order to facilitate the golf bag being carried in either hand of a user with the handle being oriented so that the bag will be balanced with the open end 24 above the lower closed end 30 to maintain the golf clubs in the bag when the bag is being carried by the handle.

Each of the straps 14 and 16 is in the form of an elongated shoulder pad 38 having a relatively short flexible strap 36 of webbing or woven material connected to each end of the pad by stitching 40. The free end of the webbing strap 36 attached to one end of one pad 38 forming strap 14 is connected to a rigid connecting ring 42 attached to the golf bag 10 at its open end 24. The ring is an open, square, oval, rectangular, D-ring or any other shaped ring having one portion fixedly or pivotally connected to a loop or hem 44 or rigidly attached to the golf bag generally in aligned relation to a portion of the open end 24 as illustrated in FIG. 1. The end of the webbing strap 36 is inserted through the ring 42 to form a loop 46 with both the free end and the portion of the strap 36 adjacent the ring extending through a slidable adjustment buckle 48 which enables the effective length of the strap 36 to be varied and enables the strap 36 to be detachably connected to ring 42.

Figure 5:
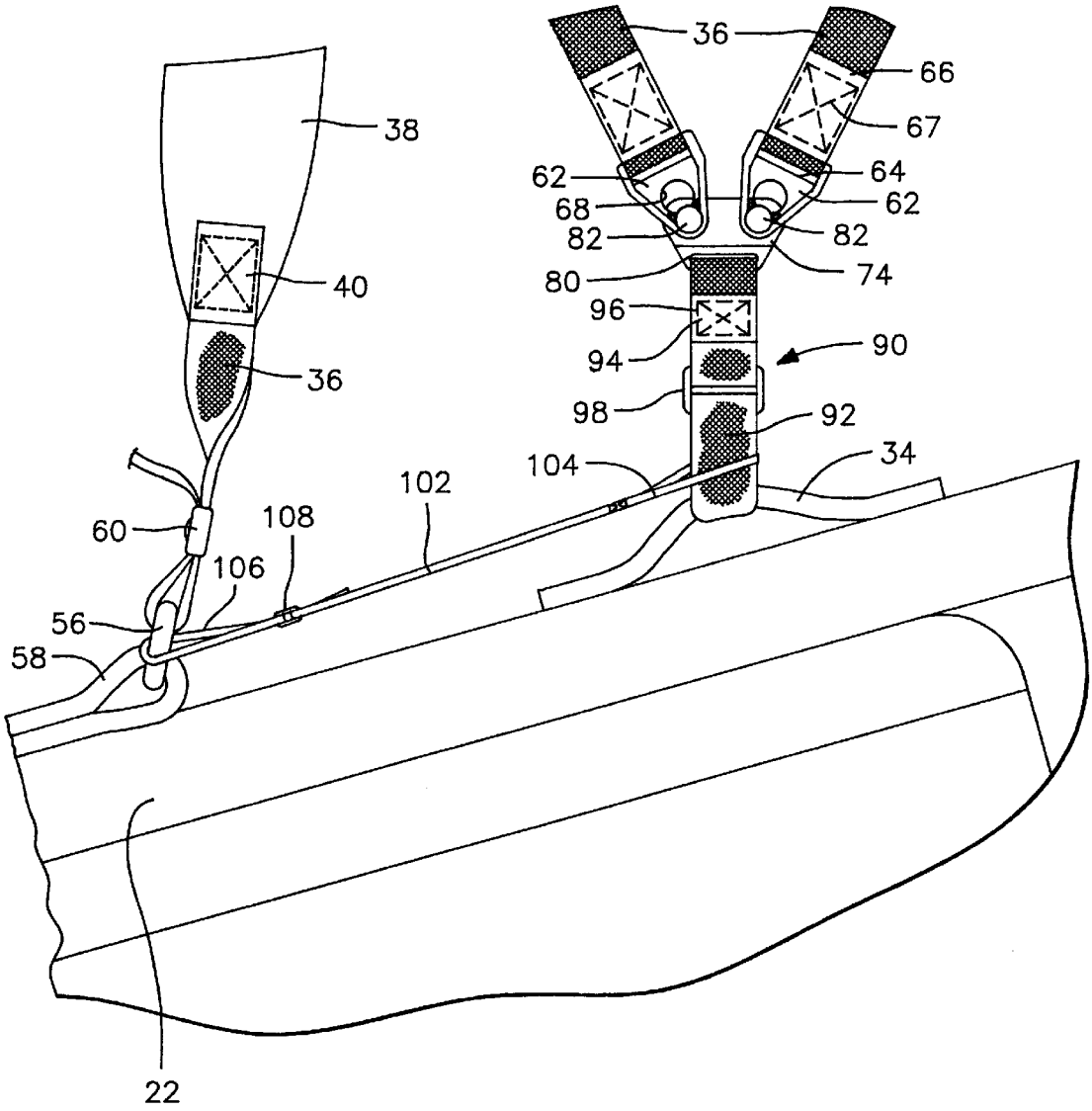
FIG. 5 is a fragmental side elevational view on an enlarged scale illustrating an alternative construction for adjusting the relationship between the retaining strap and golf bag handle to vary the balance point of the bag.

The free end of the webbing strap 36 attached to shoulder pad 38 forming the shoulder strap 16 is connected to the golf bag 10 between the handle 34 and the closed end 30 of golf bag 10 by a ring 56 similar or identical to ring 42 by a loop or hem 58 of material attached to the tubular body 22 of the golf bag. As shown in FIG. 5, the strap 36 is detachably and adjustably connected to the ring 56 by a free end portion of the strap 36 extending through the ring to form a loop and extending through a slide buckle 60.

Figure 2:
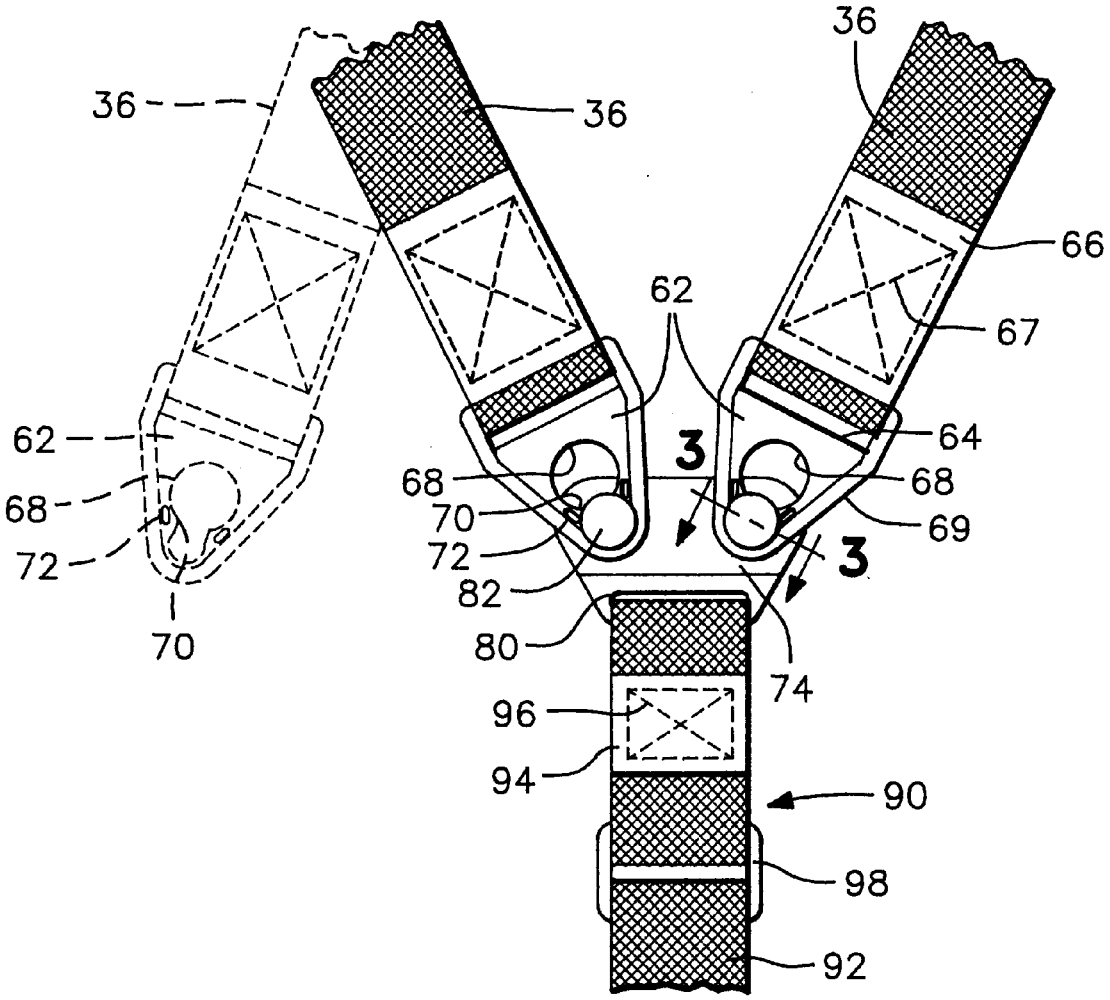
FIG. 2 is an enlarged elevational view of the connecting members at the ends of the pair of straps engaged with headed studs or pins on the corners of a connector plate with an adjustable flexible retaining strap anchored to the connector plate.

As shown in FIG. 2, the free end of each of the webbing straps 36 which terminate toward the center of the back of the golf bag carrier 12 includes a connecting member 62 having a slot 64 therein through which a free end of the strap 36 is inserted to form a loop. Wear resistant material 66 covers a portion of strap 36 adjacent connecting member 62. As illustrated in FIGS. 2 and 5, stitching 67 secures the end portion of the webbing loop, wear resistant material 66 and strap 36 together to connect the strap 36 to connecting member 62. The connecting member 62 is a one-piece flat rigid member of engineered plastic or the like such as "Deirin", a product and trademark of Dupont Co. and includes converging side edges 69. The peripheral edges of the connecting members 62 are slightly thicker than the central portion thereof to provide reinforcement to the engineered plastic connecting members. Also, each connecting member 62 is provided with a keyhole shaped opening 68 with the opposite sides of the entry between the larger diameter opening and the smaller diameter opening including opposed projections 70 with a small opening 72 formed in the projection to increase the resiliency thereof as shown in FIG. 2.

Figure 4:
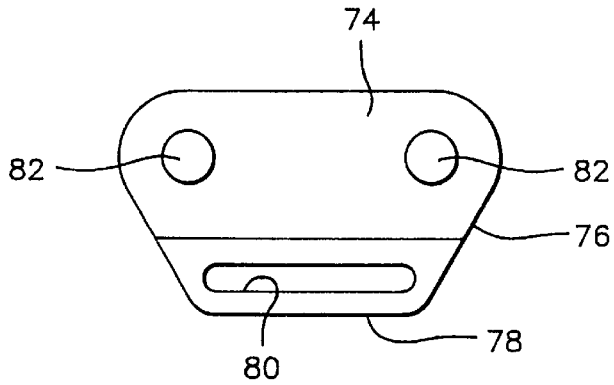
FIG. 4 is a plan view of the connector plate.
Figure 3:
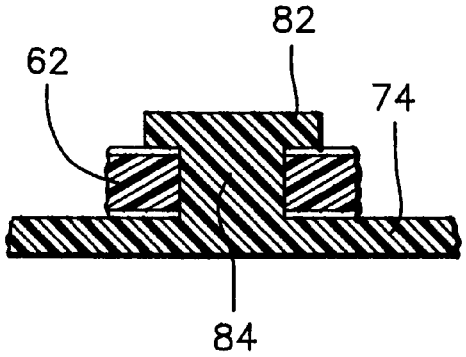
FIG. 3 is a detailed sectional view, on an enlarged scale, taken along section line 3—3 on FIG. 2 illustrating the relationship of the connecting member, headed studs or pins and connector plate on which they are mounted.

As shown in FIGS. 2–4, the connecting members 62 are detachably connected to a connector plate 74 provided with converging side edges 76 to form a shorter inner edge 78 having a slot 80 formed adjacent the inner edge 78. The opposite corners of the plate 74 adjacent the longer edge thereof includes a pair of headed or shouldered studs or pins 82 including a reduced diameter shank 84 extending to the connector plate 74 as illustrated in FIG. 3. The plate 74, studs or pins 82 including shanks 84 are of unitary construction, preferably engineered plastic material or the like such as "Delrin". The shape, size and material of the plate 74, studs or pins 82 and shank 84 may vary. The headed studs or pins 82 have a diameter that enables them to pass through the larger diameter opening of the keyhole slots 68 and the diameter of the shank 84 is such that they can snap between the projections 70 into the smaller diameter opening of the keyhole slot 68. However, the diameter of the headed portion of the headed pins 82 will not pass through the smaller diameter opening of the keyhole slot 68 thus detachably connecting the connector members 62 to the connector plate 74. The projections 70 are spaced apart a distance that will resiliently grip and engage diametrically opposed portions of the shank 84 when the shank 84 is moved into the smaller diameter opening of the keyhole slot 68 thereby providing a snap lock engagement of the connecting member 62 with the connector plate 74 to retain these components in connected relation unless a substantial force is exerted laterally on the connecting members 62 and connector plate 74 to overcome the resilient engagement of the projections 70 with the shank 84 of the headed studs or pins 82. The small slot-like openings 72 adjacent the projections 70 facilitate outward deflection of the projections 70 sufficient to enable the snap lock engagement and disengagement of the headed studs or pins 82 with the keyhole slot 68.

As shown in FIGS. 1, 2 and 5, a retaining strap 90 of webbing material adjustably and detachably extends between the connector plate 74 and the golf bag handle 34. The retaining strap 90 is in the form of a webbing strap 92 looped through the slot 80 to form a loop. Wear resistant material 94 covers a portion of strap 92 adjacent connector plate 74 and stitching 96 connects the wear resistant material 94, strap 92 and the free end of the loop to connect the strap 92 to connector plate 74. The free end of the webbing strap 92 extends through the loop portion of the handle 34 and is threaded back through an adjustable slide buckle 98 to form a loop around handle 34. This enables the retaining strap 90 to be adjusted as to its length to adjustably position the connector plate 74 toward and away from the handle 34 by threading the free end of strap 92 through slide buckle 98 and also enables detachment of the retaining strap 90 and thus detachment of the connector plate 74 from the handle 34 in order to enable both of the shoulder straps 14 and 16, the connector plate 74 and the retaining strap 90 to be separated from and assembled onto the golf bag 10.

FIG. 1 illustrates a structure to position the retaining strap 90 in an optimum position in relation to the handle 34 including a flexible retainer strap 100 connected to the interior of the handle 34 in overlying relation to that portion of the strap 92 which loops through the interior of the handle 34. The retainer strap 100 may be permanently attached to the handle 34 or connected thereto to enable adjustment of the retainer strap 100 longitudinally along the interior of the handle 34 in order to connect the retaining strap 90 in optimum relation to the handle thereby enabling the straps 14 and 16 to be optimumly arranged with respect to the center of gravity of the golf bag. The positioning of the connecting members 62 at the corners of the connector plate 74 provides a spatial relationship between the points of application of supporting force to the golf bag to provide substantially equal division of supporting force on each of the shoulder straps 14 and 16 thereby imparting substantially an equal load to each of the shoulders to reduce fatigue and reduce the possibility of excessive stress being exerted on one of the shoulders.

As shown in FIG. 5, the point of engagement between the retaining strap 90 and the handle 34 on the golf bag can be varied by using a narrow adjustment strap 102 in lieu of retainer strap 100. One end of the adjustment strap 102 is provided with a loop 104 positioned around that portion of webbing strap 92 which loops around handle 34. The other end of adjustment strap 102 is looped through ring 56 at 106 with the free end extending through slidable adjustment buckle 108 to vary the effective length of adjustment strap 102 and enabling the adjustment strap 102 to be disconnected from ring 56. This enables longitudinal adjustment of the balance point of the golf bag 10 when supported by one or both supporting straps 12 and 14 to assure that the open end 24 of the bag 10 is oriented above the closed end when being carried. The strap 102 is a flexible webbing strap which is less than one half of the width of straps 36 and 92 and can be permanently attached to strap 92 or detachably looped around the strap 92 adjacent handle 34.

The provision of the pair of detachable and adjustable shoulder straps to supportingly engage both of the shoulders does not preclude the use of a single shoulder strap such as strap 14 to support the bag over either one of the shoulders of the golf bag carrier. This enables the unused shoulder strap 16 to be totally disconnected and stored and still enables the shoulder strap 14 to be connected to either of the headed studs or pins 82 and enables the retaining strap 90 to be oriented in optimum relation to the handle 34 thereby enabling the single shoulder strap 14 to support the golf bag from either shoulder in the manner of using a conventional single strap golf bag. Also, both shoulder straps can be made available as an accessory for connection with rings normally provided on golf bags.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A golf bag having an open end for receiving golf clubs and a handle attached to the golf bag adjacent the open end, a pair of flexible supporting straps oriented longitudinally of the golf bag in generally aligned relation with the handle, each of said supporting straps including one end connected to said golf bag in spaced relation to said handle and another end oriented adjacent said handle, each another end of said supporting straps including a connecting member on the end thereof remote from said one end of the supporting strap, said connecting members being detachably connected to a connector plate, a retaining strap extending between the connector plate and said handle to enable the pair of supporting straps to extend over and support the golf bag from both shoulders of a person carrying the bag.

2. The golf bag as defined in claim 1, wherein said connecting members each have a keyhole shaped slot therein, said connector plate including a pair of spaced headed studs thereon for detachable connection with the connecting members by respectively inserting the studs into the keyhole slots.

3. The golf bag as defined in claim 1, wherein said retaining strap includes a loop at each end thereof with one loop extending through the handle and through a slidable adjustable buckle to vary the effective length of the retaining strap and detachably connect the retaining strap to said handle, the other loop extending through a slot in the connector plate and stitched to itself to vary the spacial relation between the handle and connector plate.

4. The golf bag as defined in claim 3, wherein said handle on the golf bag includes a retainer strap on the interior thereof for retaining said one loop of the retaining strap extending through the handle in a longitudinal position on the handle.

5. The golf bag as defined in claim 1, wherein said open end of the golf bag includes a rigid ring connected to the bag at the open end thereof, the one end of one of said supporting straps is connected at the open end of the bag by extending through the ring and through a slidable adjustment buckle to enable the effective length of the one supporting strap connected to the open end of the bag to be adjusted and detachably connect said one supporting strap to said ring.

6. The golf bag as defined in claim 5, wherein the one end of the other of said supporting straps is connected to a ring on the golf bag on the opposite side of the handle from the open end.

7. The golf bag as defined in claim 1, wherein each of said supporting straps includes a shoulder pad for cushioning engagement with the shoulders of a person carrying the golf bag and a webbing strap connected to each end of each shoulder pad.

8. The golf bag as defined in claim 6, wherein said connecting members each have a keyhole shaped slot therein, said connector plate including a pair of spaced headed studs thereon for detachable connection with the connecting members by respectively inserting the studs into the keyhole slots.

9. The golf bag as defined in claim 8, wherein the another end of each supporting strap is connected to a respective one of the connecting members by inserting a free end thereof through a slot in the connecting member to form a loop and wear resistant material covering a portion of said supporting strap adjacent said loop, and stitch connecting said wear resistant material, said supporting strap, and an end portion of said loop for securely connecting the connecting member to the supporting strap.

10. The golf bag as defined in claim 9, wherein said retaining strap includes a loop at each end thereof with one loop extending through the handle and through a slidable adjustable buckle to vary the effective length of the retaining strap and detachably connect the retaining strap to the handle, the other loop of said retaining strap extending through a slot in the connector plate and stitched to itself to vary the spacial relation between the handle and connector plate.

11. The golf bag as defined in claim 10, wherein said handle on the golf bag includes a retainer strap on the interior thereof for retaining said one loop of the retaining strap extending through the handle in a longitudinal position on the handle.

12. A carrying assembly for a golf bag having an open end for receiving golf clubs and a carrying handle adjacent the open end of the bag, said carrying assembly enabling the golf bag to be carried while supported from both shoulders of a person carrying the bag, said assembly comprising a pair of elongate flexible shoulder straps, each of said straps having one end connectable to the bag at points generally aligned with the handle with one of the straps having the one end connectable to the golf bag adjacent the open end of the bag and the other of the straps having the one end connectable to the bag on the opposite side of the handle from the open end, each of said straps having a connecting member on an opposing end of each said shoulder strap remote from the golf bag, a retaining strap connectable to the golf bag handle and including a connector plate to which the connecting members are detachably connected, said retaining strap being flexible and adjustable to vary the spatial relation between the connecting members on the opposing ends of the elongate straps and the golf bag handle.

13. The carrying assembly as defined in claim 12, wherein said connector plate and said connecting members include a positive detachable connection to prevent inadvertent disconnections of the opposing ends of the elongate straps from the connector plate and enabling disconnection of the opposing ends of the elongate strap from the connector plate by disabling said positive connection between the connector plate and the connecting members.

14. The carrying assembly as defined in claim 13, wherein the one end of each said shoulder strap includes an adjustable, detachable connection to said golf bag to enable assembly and disassembly of said shoulder straps with respect to the golf bag.

15. The carrying assembly as defined in claim 14, wherein said shoulder straps each include an elongate shoulder pad and a flexible strap connected to each end of each shoulder pad, said retaining strap being looped through the handle and retained in longitudinal position in relation to the longitudinal extent of the handle to maintain an optimum balance point of the golf bag in relation to the carrying assembly.

16. The carrying assembly as defined in claim 12 wherein the carrying assembly further comprising a narrow adjustment strap having one end connected with said retaining strap adjacent the golf bag handle and another end connectable to the golf bag and longitudinally spaced from the one end of the adjustment strap and the golf bag handle, said adjustment strap being adjustable to adjust the point of supporting engagement of the retaining strap with the handle to adjust the balance point of the golf bag when supported by said shoulder straps.

* * * * *